US007830234B1

(12) United States Patent
Tien et al.

(10) Patent No.: US 7,830,234 B1
(45) Date of Patent: Nov. 9, 2010

(54) TRANSFORMER STRUCTURE

(75) Inventors: Ching-Hsiang Tien, Taoyuan Hsien (TW); Hsiang-Yi Tseng, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/546,932

(22) Filed: Aug. 25, 2009

(30) Foreign Application Priority Data

Jun. 3, 2009 (TW) ..... 98118467 A

(51) Int. Cl.
*H01F 27/30* (2006.01)

(52) U.S. Cl. ..... 336/208; 336/198; 336/192

(58) Field of Classification Search ..... 336/208, 336/198, 192
See application file for complete search history.

(56) References Cited

U.S. PATENT DOCUMENTS 5,534,839 A * 7/1996 Mackin et al. ..... 336/192
7,199,694 B2 * 4/2007 Hao ..... 336/208
7,696,851 B1 * 4/2010 Ger et al. ..... 336/198
7,714,689 B1 * 5/2010 Hsieh ..... 336/208
7,724,115 B2 * 5/2010 Chen et al. ..... 336/198
7,760,063 B2 * 7/2010 Lin et al. ..... 336/208

* cited by examiner

*Primary Examiner*—Anh T Mai
(74) *Attorney, Agent, or Firm*—Kirton & McConkie; Evan R. Witt

(57) ABSTRACT

A transformer includes a bobbin assembly, a magnetic core covering element, and a magnetic core assembly. The bobbin assembly includes a primary bobbin, a first secondary bobbin and a first channel. The primary bobbin includes a first sheathing part. At least one primary winding coil is wound around the primary bobbin. The first sheathing part has a first receptacle. A separation structure is formed within the first receptacle. The first secondary bobbin is accommodated within the first receptacle. A first secondary winding coil is wound around the first secondary bobbin and includes a wound segment and a returned segment. The wound segment and the returned segment are separated from each other by the separation structure. The magnetic core covering element is coupled with the bobbin assembly, and includes a second channel. The magnetic core assembly is partially embedded into the first channel and the second channel.

19 Claims, 11 Drawing Sheets

3

3

3

3

TRANSFORMER STRUCTURE

FIELD OF THE INVENTION

The present invention relates to a transformer, and more particularly to a transformer for enhancing the electrical safety between the winding coils and the electrical safety between the coils and the magnetic core assembly, thereby avoiding high-voltage spark.

BACKGROUND OF THE INVENTION

A transformer has become an essential electronic component for voltage regulation into required voltages for various kinds of electric appliances. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are overlapped with each other and wounded around a winding section 121 of the bobbin 12. An isolating tape 15 is provided for isolation and insulation. The magnetic core assembly 11 includes a first magnetic part 111 and a second magnetic part 112. The middle portion 111*a* of the first magnetic part 111 and the middle portion 112*a* of the second magnetic part 112 are embedded into the channel 122 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance. Related technologies were developed to increase coupling coefficient and reduce leakage inductance of the transformer so as to reduce power loss upon voltage regulation. In the transformer of FIG. 1, the primary winding coil 13 and the secondary winding coil 14 are overlapped with each other and wounded around the bobbin 12. As a consequence, there is less magnetic flux leakage generated from the primary winding coil 13 and the secondary winding coil 14. Under this circumstance, since the coupling coefficient is increased, the leakage inductance of the transformer is reduced and the power loss upon voltage regulation is reduced, the electric conversion efficiency of a power converter is enhanced.

In the new-generation electric products (e.g. LCD televisions), a backlight module is a crucial component for driving the light source because the LCD panel fails to illuminate by itself. Generally, the backlight module comprises a plurality of discharge lamps and a power supply system for driving these lamps. The discharge lamps are for example cold cathode fluorescent lamps (CCFLs). These discharge lamps are driven by an inverter circuit of the power supply system. As the size of the LCD panel is gradually increased, the length and the number of the lamps included in the LCD panel are increased and thus a higher driving voltage is required. Under this circumstance, the transformer of the inverter circuit is usually a high-voltage transformer with leakage inductance. For electrical safety, the primary winding coil and the secondary winding coil of such a transformer are separated by a partition element of the bobbin. Generally, the current generated from the power supply system will pass through a LC resonant circuit composed of an inductor L and a capacitor C, wherein the inductor L is inherent in the primary winding coil of the transformer. At the same time, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch, minimize noise and enhance performance.

Referring to FIG. 2, a schematic exploded view of a transformer used in the conventional LCD panels is illustrated. The transformer 2 of FIG. 2 comprises a magnetic core assembly 21, a first bobbin piece 22, a second bobbin piece 23, a primary winding coil 24 and a secondary winding coil 25. The first bobbin piece 22 has a first side plate 26. The second bobbin piece 23 has a second side plate 27 and a plurality of partition plates 23*a*. Several winding sections 23*b* are defined by any two adjacent partition plates 23*a*. According to a voltage dividing principle, the number of winding sections 23*b* may be varied depending on the voltage magnitude. In addition, a first base 26*a* and a second base 27*a* are extended from the first side plate 26 and the second side plate 27, respectively. Several pins 28 and 29 are respectively arranged on the bottom surfaces of the first base 26*a* and the second base 27*a*.

For winding the primary winding coil 24 on the first bobbin piece 22, a first terminal of the primary winding coil 24 is firstly soldered on a pin 28*a* under the first base 26*a*. The primary winding coil 24 is then successively wound on the first bobbin piece 22 in the direction distant from the first side plate 26. Afterward, a second terminal of the primary winding coil 24 is returned to be soldered onto another pin 28*b* under the first base 26*a*. For winding the secondary winding coil 25 on the second bobbin piece 23, a first terminal of the secondary winding coil 25 is firstly soldered on a pin 29*a* under the second base 27*a*. The secondary winding coil 25 is then successively wound on the winding sections 23*b* of the second bobbin piece 23 in the direction distant from the second side plate 27. Afterward, a second terminal of the secondary winding coil 25 is returned to be soldered onto another pin 29*b* under the second base 27*a*. Moreover, due to the partition plate 23*a* of the second bobbin piece 23, the primary winding coil 24 is separated from the secondary winding coil 25, thereby maintaining an electrical safety distance and increasing leakage inductance of the transformer 2.

The winding structure of the transformer 2, however, still has some drawbacks. Since the transformer 2 is applied to the driver circuit of the power supply system, a higher driving voltage is required. If the voltage difference between the primary winding coil 24 and the secondary winding coil 25 is too high or the safety distance is insufficient, the transformer 2 is readily suffered from high-voltage spark. Moreover, since the magnetic core assembly 21 is partially exposed and disposed adjacent to the primary winding coil 24 and the secondary winding coil 25, the safety distance between the winding coils and the magnetic core assembly 21 is insufficient. In addition, since the primary winding coil 24 and the secondary winding coil 25 are returned back to be respectively soldered onto the pins 28*b* and 29*b* under the first base 26*a* and the second base 27*a*, portions of the primary winding coil 24 and the secondary winding coil 25 are exposed under the first bobbin piece 22 and the second bobbin piece 23. Under this circumstance, the transformer 2 is readily suffered from high-voltage spark or short circuit and eventually has a breakdown.

Therefore, there is a need of providing an improved transformer so as to obviate the drawbacks encountered from the prior art.

SUMMARY OF THE INVENTION

It is an object of the present invention to provide a transformer for enhancing the electrical safety between the winding coils and the electrical safety between the coils and the magnetic core assembly, thereby avoiding high-voltage spark.

Another object of the present invention provides a modular transformer so as to expand the applications thereof.

In accordance with an aspect of the present invention, there is provided a transformer. The transformer includes a bobbin assembly, a magnetic core covering element, and a magnetic core assembly. The bobbin assembly includes a primary bobbin, a first secondary bobbin and a first channel. The primary bobbin includes a first sheathing part. At least one primary winding coil is wound around the primary bobbin. The first sheathing part has a first receptacle. A separation structure is formed within the first receptacle of the first sheathing part. The first secondary bobbin is accommodated within the first receptacle of the first sheathing part. A first secondary winding coil is wound around the first secondary bobbin and includes a wound segment and a returned segment. The wound segment and the returned segment are separated from each other by the separation structure. The magnetic core covering element is coupled with the bobbin assembly, and includes a second channel. The magnetic core assembly is partially embedded into the first channel of the bobbin assembly and the second channel of the magnetic core covering element.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
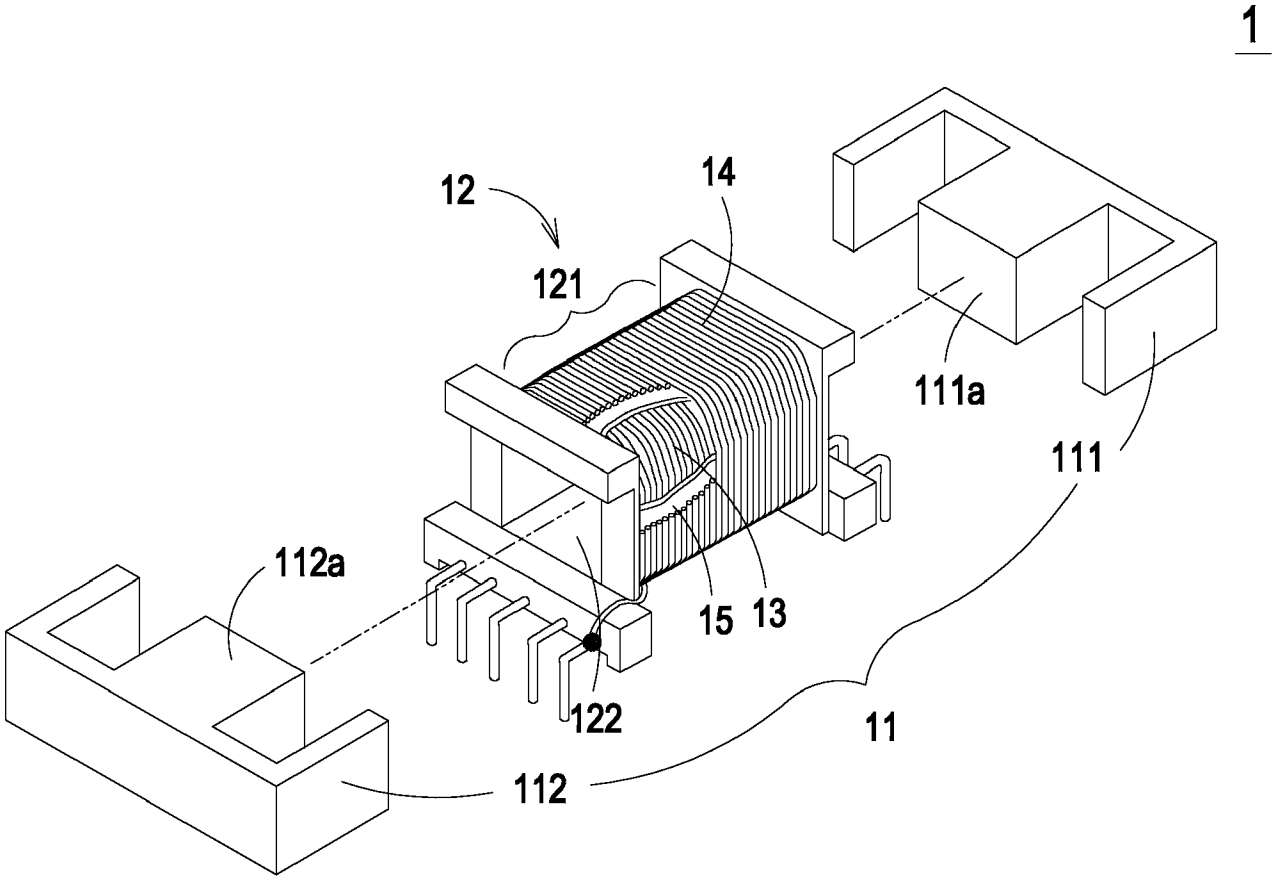
FIG. 1 PRIOR ART
FIG. 1 is a schematic exploded view of a conventional transformer.
Figure 2:
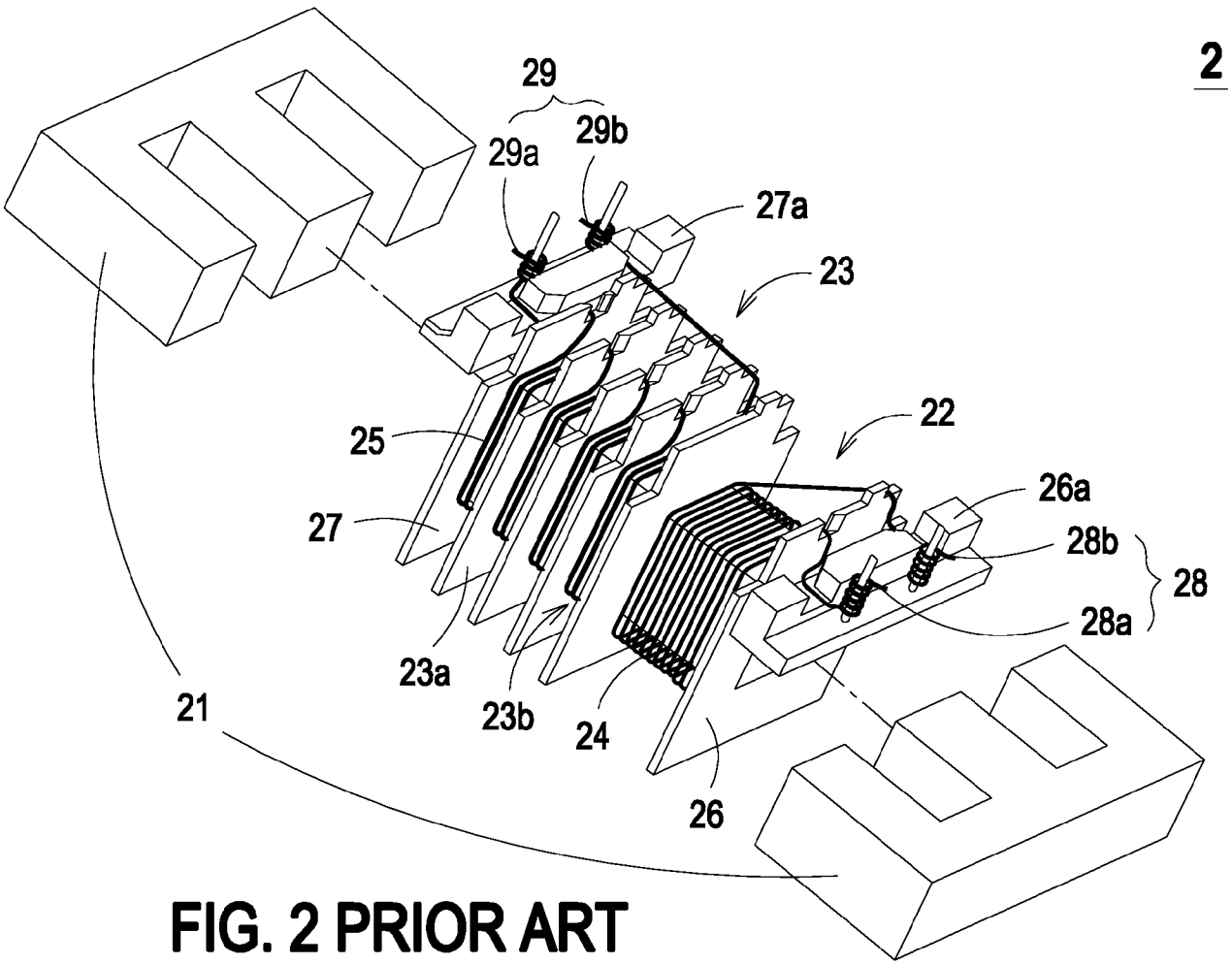
FIG. 2 PRIOR ART
FIG. 2 is a schematic exploded view illustrating a transformer used in the conventional LCD panels.
Figure 3A:
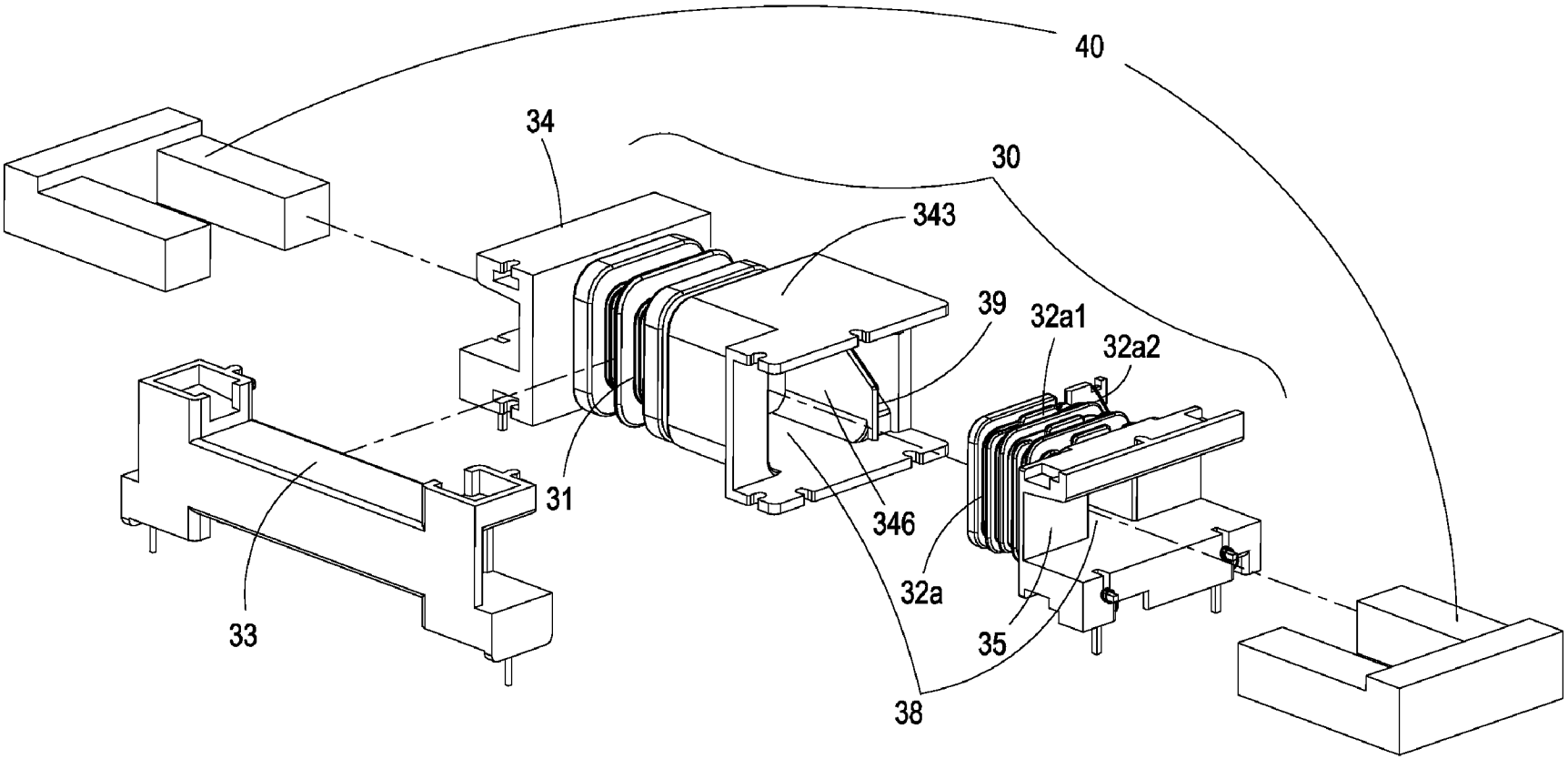
FIG. 3A is a schematic exploded view of a transformer according to a first embodiment of the present invention and taken in a front-side viewpoint.
Figure 3B:
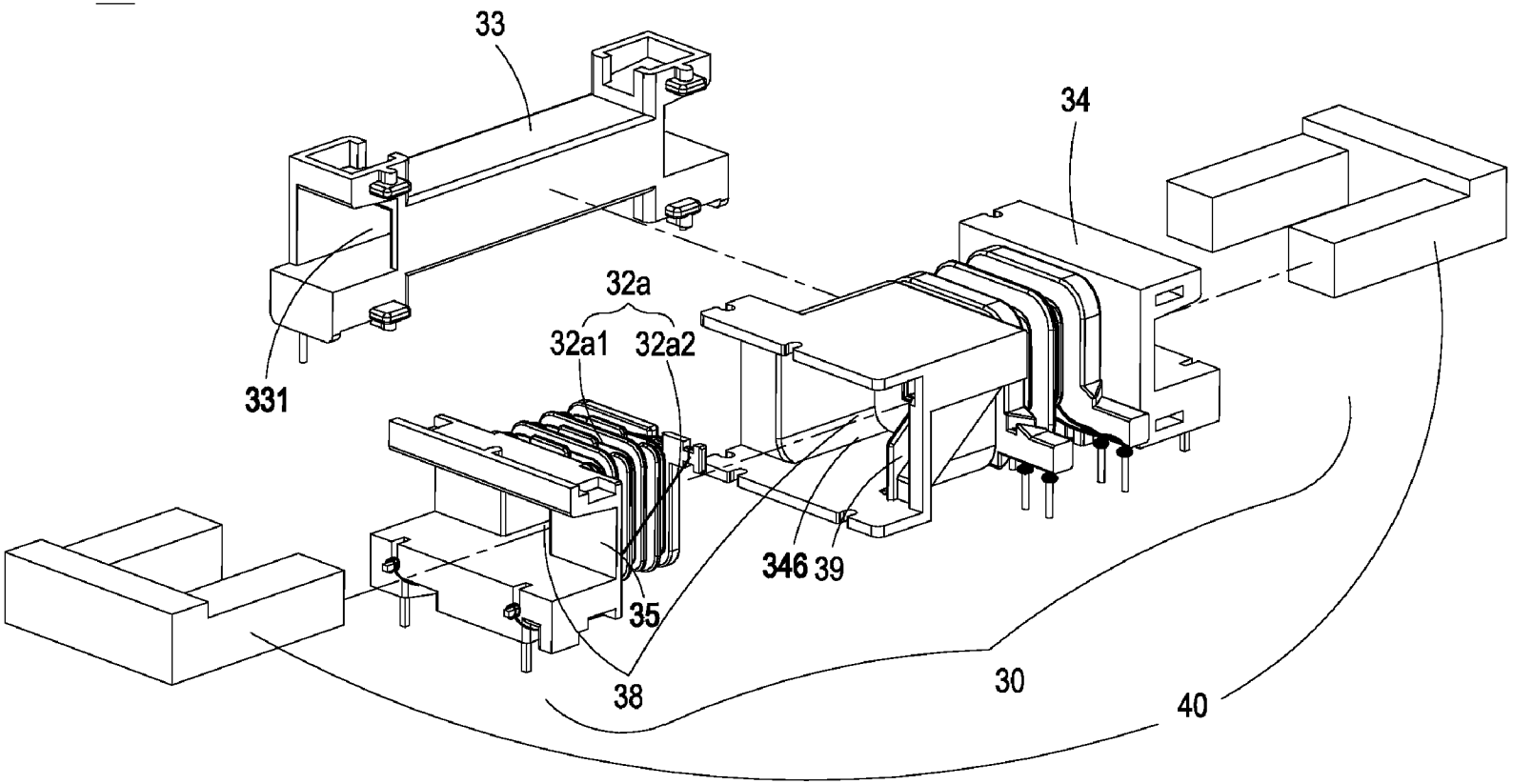
FIG. 3B is a schematic exploded view of the transformer shown in FIG. 3A and taken in a back-side viewpoint.

FIG. 3A is a schematic exploded view of a transformer according to a first embodiment of the present invention and taken in a front-side viewpoint. FIG. 3B is a schematic exploded view of the transformer shown in FIG. 3A and taken in a back-side viewpoint. Please refer to FIG. 3A and FIG. 3B. The transformer 3 comprises a bobbin assembly 30, at least one primary winding coil 31, a first secondary winding coil 32*a*, a magnetic core covering element 33 and a magnetic core assembly 40. The bobbin assembly 30 includes a primary bobbin 34, a first secondary bobbin 35 and a first channel 38. The primary winding coil 31 is wound around the primary bobbin 34. The primary bobbin 34 further includes a first sheathing part 343. The first secondary winding coil 32*a* is wound around the first secondary bobbin 35. The first secondary bobbin 35 is accommodated within a first receptacle 346 of the first sheathing part 343 of the primary bobbin 34. A separation structure 39 is formed within the first receptacle 346 of the first sheathing part 343. The first secondary winding coil 32*a* wound around the first secondary bobbin 35 includes a wound segment 32*a*1 and a returned segment 32*a*2. After the first secondary bobbin 35 is accommodated within the first receptacle 346, the wound segment 32*a*1 and the returned segment 32*a*2 are separated from each other by the separation structure 39. The magnetic core covering element 33 is coupled with the bobbin assembly 30. The magnetic core covering element 33 has a second channel 331. The magnetic core assembly 40 is partially embedded into the first channel 38 of the bobbin assembly 30 and the second channel 331 of the magnetic core covering element 33. As such, the primary winding coil 31 and the first secondary winding coil 32*a* interact with the magnetic core assembly 40 to achieve the purpose of voltage regulation. Moreover, the use of the magnetic core covering element 33 can increase the safety distance between the winding coils and the safety distance between the winding coils and the magnetic core assembly 40.

Figure 4A:
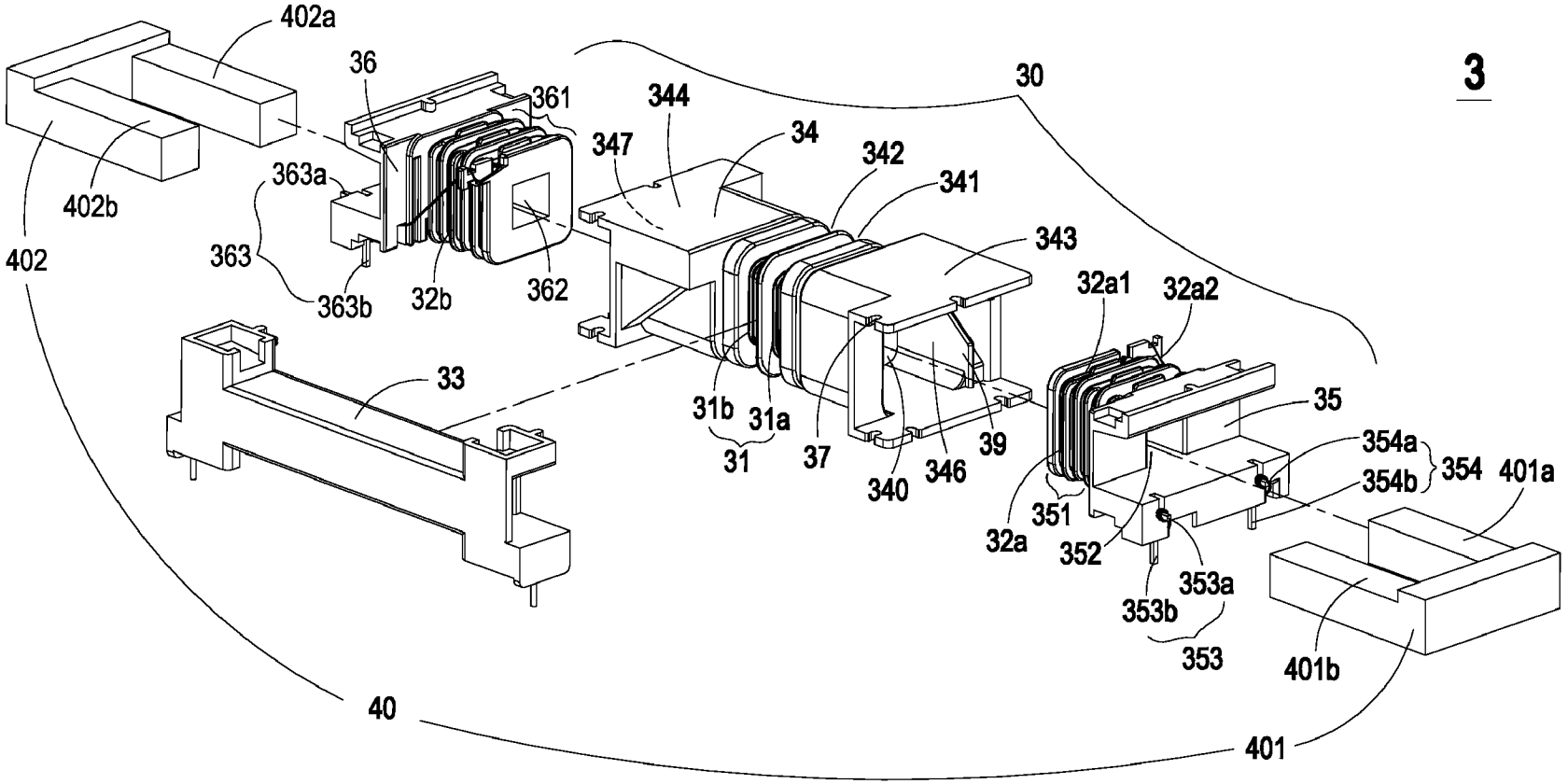
FIG. 4A is a schematic exploded view of a transformer according to a second embodiment of the present invention and taken in a front-side viewpoint.
Figure 4B:
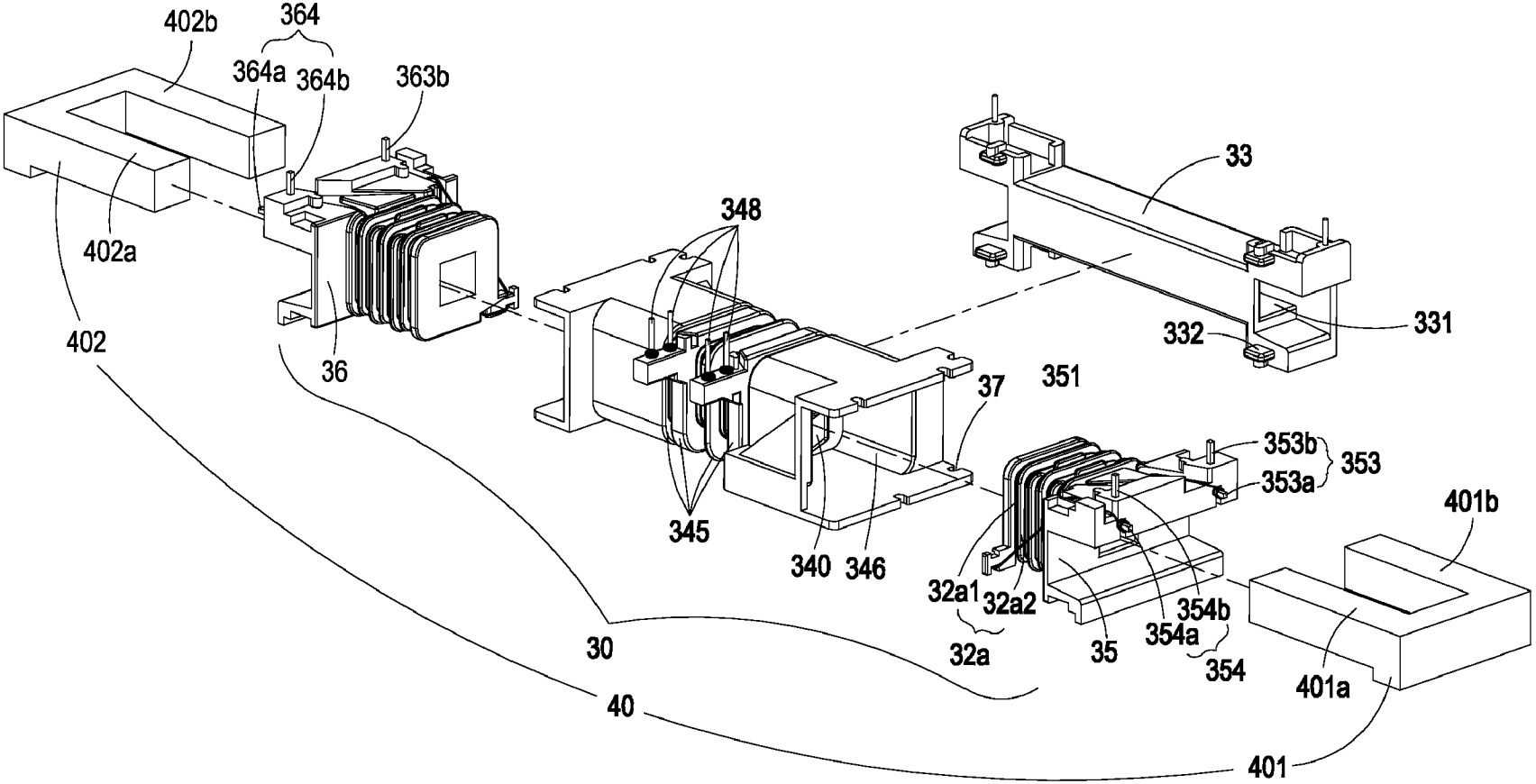
FIG. 4B is a schematic exploded view of the transformer shown in FIG. 4A and taken in a back-side viewpoint.

FIG. 4A is a schematic exploded view of a transformer according to a second embodiment of the present invention and taken in a front-side viewpoint. FIG. 4B is a schematic exploded view of the transformer shown in FIG. 4A and taken in a back-side viewpoint. Please refer to FIG. 4A and FIG. 4B. The transformer 3 comprises a bobbin assembly 30, a first primary winding coil 31*a*, a second primary winding coil 31*b*, a first secondary winding coil 32*a*, a second secondary winding coil 32*b*, a magnetic core covering element 33 and a magnetic core assembly 40. The bobbin assembly 30 includes a primary bobbin 34, a first secondary bobbin 35 and a second secondary bobbin 36. The primary bobbin 34 includes a first primary winding section 341, a second primary winding section 342, a first sheathing part 343, a second sheathing part 344 and a first through-hole 340. The first secondary bobbin 35 includes a first secondary winding section 351 and a second through-hole 352. The second secondary bobbin 36 includes a second secondary winding section 361 and a third through-hole 362. The first primary winding coil 31*a* and the second primary winding coil 31*b* are respectively wound around the first primary winding section 341 and the second primary winding section 342 of the primary bobbin 34. The first secondary winding coil 32*a* and the second secondary winding coil 32*b* are respectively wound around the first secondary winding section 351 of the first secondary bobbin 35 and the secondary winding section 361 of the second secondary bobbin 36. The first secondary bobbin 35 is partially received in the first sheathing part 343 of the primary bobbin 34. The second secondary bobbin 36 is partially received in the second sheathing part 344 of the primary bobbin 34. The first through-hole 340 of the primary bobbin 34, the second through-hole 352 of the first secondary bobbin 35 and the third through-hole 362 of the second secondary bobbin 36 collectively define a first channel 38 of the bobbin assembly 30. The magnetic core covering element 33 is combined with the bobbin assembly 30, and includes a second channel 331. The bobbin assembly 30 includes a first connecting part 37. The magnetic core covering element 33 includes a second connecting part 332. The first connecting part 37 of the bobbin assembly 30 and the second connecting part 332 of the magnetic core covering element 33 are coupled with or engaged with each other. As such, the magnetic core covering element 33 and the bobbin assembly 30 are detachably connected with each other.

Please refer to FIG. 4A and FIG. 4B again. The magnetic core assembly 40 includes a first magnetic part 401 and a second magnetic part 402. The first magnetic part 401 includes a first lateral leg 401*a* and a second lateral leg 401*b*. The second magnetic part 402 includes a first lateral leg 402*a* and a second lateral leg 402*b*. The first lateral leg 401*a* of the first magnetic part 401 is embedded into the first channel 38 through the second through-hole 352 of the first secondary bobbin 35. The first lateral leg 402*a* of the second magnetic part 402 is embedded into the first channel 38 through the third through-hole 362 of the second secondary bobbin 36. The second lateral leg 401*b* of the first magnetic part 401 and the second lateral leg 402*b* of the second magnetic part 402 are embedded into the second channel 331. As such, the primary winding coils 31*a*, 31*b* and the secondary winding coils 32*a*, 32*b* interact with the magnetic core assembly 40 to achieve the purpose of voltage regulation. Moreover, the use of the magnetic core covering element 33 can increase the safety distance between the primary winding coils 31*a*, 31*b* and the magnetic core assembly 40 and the safety distance between the secondary winding coils 32*a*, 32*b* and the magnetic core assembly 40.

In this embodiment, the first primary winding section 341, the second primary winding section 342, the first sheathing part 343 and the second sheathing part 344 of the primary bobbin 34 are separated from each other by one or more partition plates 345. The first sheathing part 343 and the second sheathing part 344 are arranged at opposite sides of the primary bobbin 34. The first primary winding section 341 and the second primary winding section 342 are arranged between the first sheathing part 343 and the second sheathing part 344. It is preferred that the primary bobbin 34 is made of insulating material and integrally formed into a one-piece structure. In addition, the magnetic core covering element 33 is made of insulating material and integrally formed into a one-piece structure.

In this embodiment, the first sheathing part 343 has a first receptacle 346 for accommodating the first secondary winding section 351 of the first secondary bobbin 35 and the first secondary winding coil 32*a* wound around the first secondary winding section 351. The second sheathing part 344 has a second receptacle 347 for accommodating the second secondary winding section 361 of the second secondary bobbin 36 and the second secondary winding coil 32*b* wound around the second secondary winding section 361. In addition, the first through-hole 340 is communicated with the first receptacle 346 and the second receptacle 347. By the first sheathing part 343, the primary winding coils 31*a*, 31*b* are isolated from the first secondary winding coil 32*a* so as to provide a desired safety distance between the primary winding coils 31*a*, 31*b* and the first secondary winding coil 32*a*. By the second sheathing part 344, the primary winding coils 31*a*, 31*b* are isolated from the second secondary winding coil 32*b* so as to provide a desired safety distance between the primary winding coils 31*a*, 31*b* and the second secondary winding coil 32*b*.

In this embodiment, the primary bobbin 34 further includes several pins 348. The pins 348 are connected to the terminals of the first primary winding coil 31*a* or the second primary winding coil 31*b*. In addition, the pins 348 are inserted into corresponding holes of a circuit board (not shown). The pins 348 are arranged on the extension part of the partition plate 345. In this embodiment, the first secondary bobbin 35 has at least one first pin 353 and one second pin 354. The second secondary bobbin 36 has at least one first pin 363 and one second pin 364. The first pin 353 of the first secondary bobbin 35 has a first coupling part 353*a* and a second coupling part 353*b*, which are perpendicular to each other. The first pin 363 of the second secondary bobbin 36 has a first coupling part 363*a* and a second coupling part 363*b*, which are perpendicular to each other. The second pin 354 of the first secondary bobbin 35 has a first coupling part 354*a* and a second coupling part 354*b*, which are perpendicular to each other. The second pin 364 of the second secondary bobbin 36 has a first coupling part 364*a* and a second coupling part 364*b*, which are perpendicular to each other. The first coupling parts 353*a*, 363*a* of the first pin 353, 363 are respectively connected to a first terminal of the first secondary winding coil 32*a* and a first terminal of the second secondary winding coil 32*b*. The second coupling part 353*b*, 363*b* of the first pin 353, 363 are inserted into corresponding holes of the circuit board. The first coupling parts 354*a*, 364*a* of the second pin 354, 364 are respectively connected to a second terminal of the first secondary winding coil 32*a* and a second terminal of the second secondary winding coil 32*b*. The second coupling part 354*b*, 364*b* of the second pin 354, 364 are inserted into corresponding holes of the circuit board. The first coupling parts 353*a*, 363*a*, 354*a*, 364*a* and the second coupling part 353*b*, 363*b*, 354*b*, 364*b* are made of conductive material such as copper or aluminum. The first coupling parts 353*a* and the second coupling part 353*b* of the first pin 353 are integrally formed such that the first pin 353 is L-shaped. Similarly, the first coupling part 363*a* and the second coupling part 363*b* of the first pin 363 are integrally formed such that the first pin 363 is L-shaped. Similarly, the first coupling parts 354*a* and the second coupling part 354*b* of the second pin 354 are integrally formed such that the second pin 354 is L-shaped. Similarly, the first coupling parts 364*a* and the second coupling part 364*b* of the second pin 364 are integrally formed such that the second pin 364 is L-shaped.

Since the first coupling parts 353*a*, 363*a* of the first pin 353, 363 are respectively connected to the first terminals of the winding coil 32*a*, 32*b*, the second coupling part 353*b*, 363*b* of the first pin 353, 363 are inserted into corresponding holes of the circuit board, the first coupling parts 354*a*, 364*a* of the second pin 354, 364 are respectively connected to the second terminals of the winding coils 32*a*, 32*b* and the second coupling part 354*b*, 364*b* of the second pin 354, 364 are inserted into corresponding holes of the circuit board, the transformer 3 is electrically connected with the circuit board through the pins 353, 354, 363 and 364. In addition, the L-shaped pins have stronger structural strength and reduced height. Since the outlet terminals of the winding coils are connected to the first coupling parts, the outlet terminals are no longer arranged between the pins and the circuit board. Under this circumstance, the pins' evenness is enhanced.

Figure 5A:
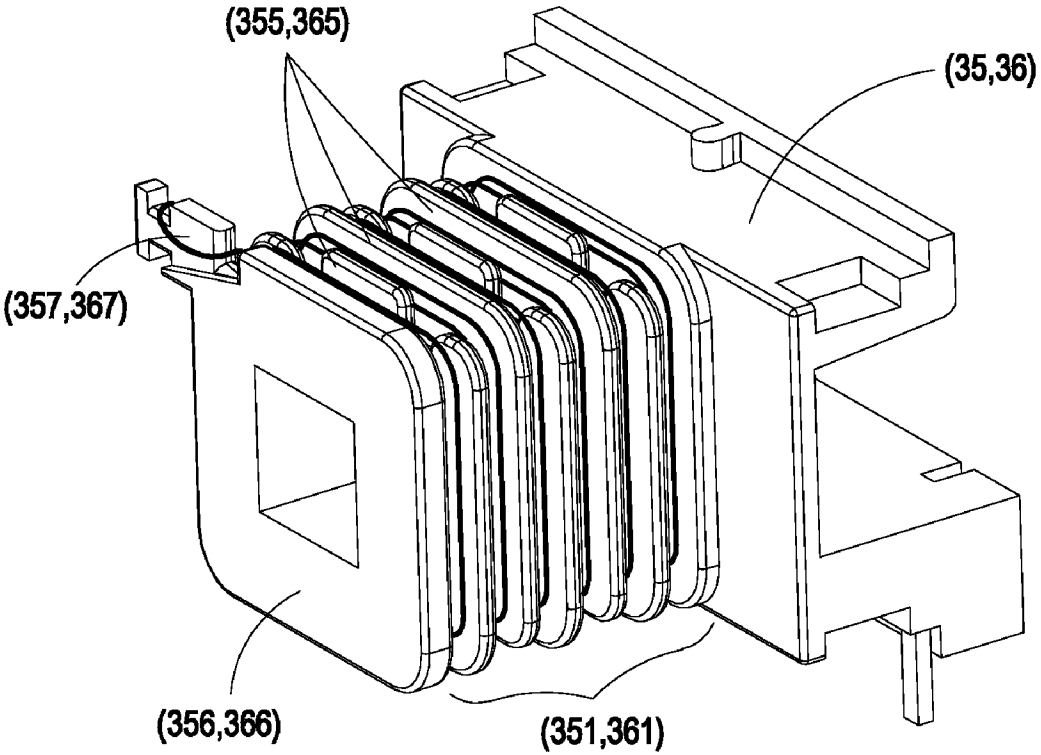
FIGS. 5A, 5B and 5C are schematic perspective views illustrating the first secondary bobbin or the second secondary bobbin of the transformer shown in FIG. 4 and taken from different viewpoints.
Figure 5B:
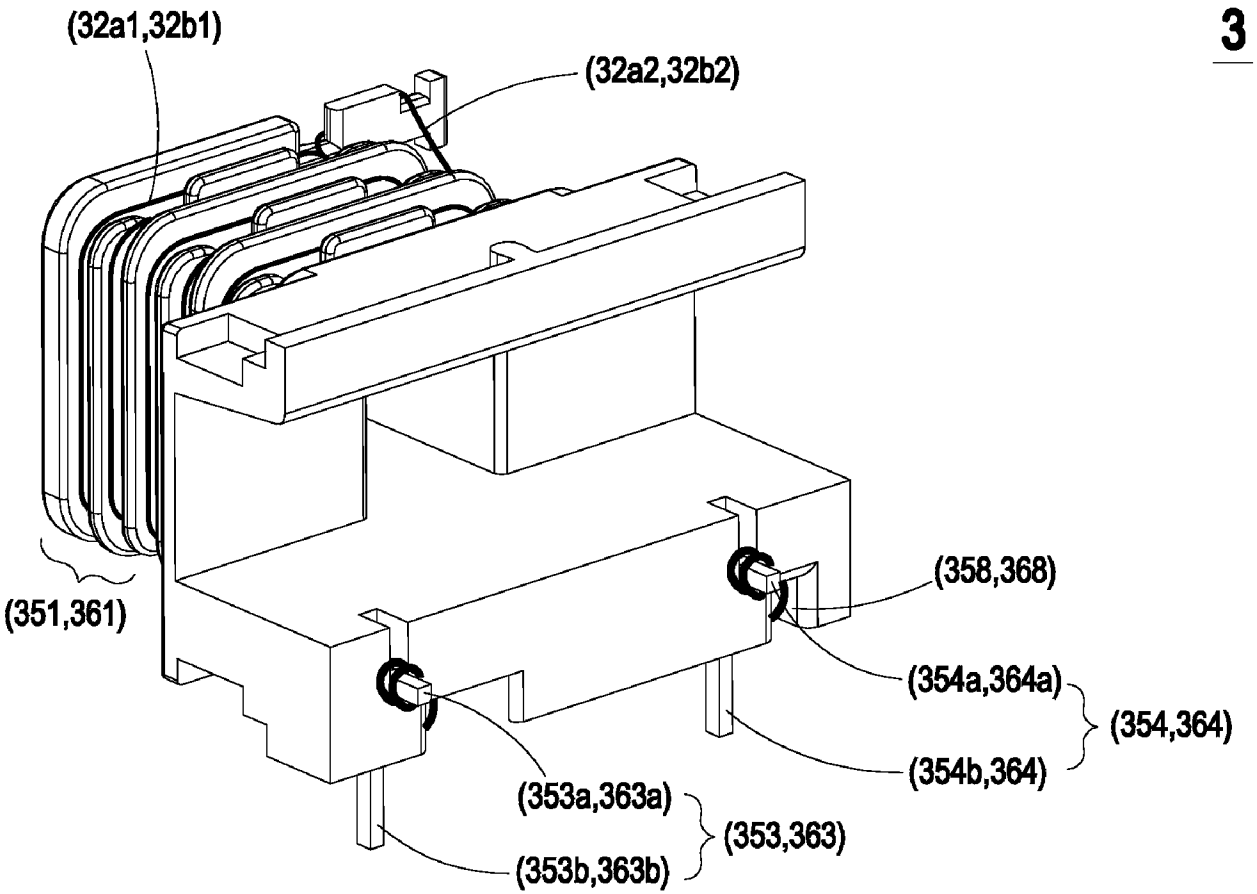
Figure 5C:
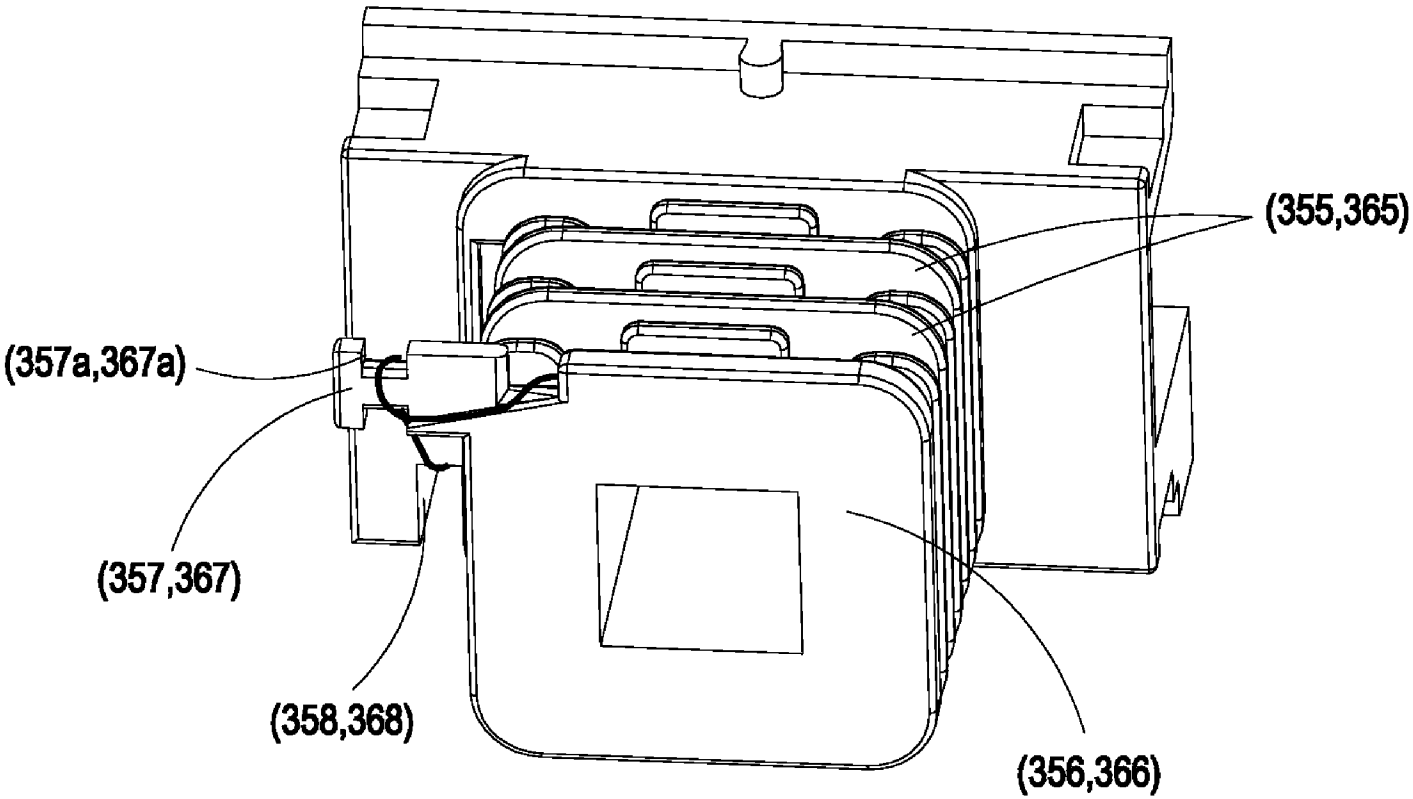

FIGS. 5A, 5B and 5C are schematic perspective views illustrating the first secondary bobbin or the second secondary bobbin of the transformer shown in FIG. 4 and taken from different viewpoints. Please refer to FIGS. 4A, 4B and 5A-5C. In this embodiment, the first secondary bobbin 35 includes multiple partition plates 355 and a side plate 356, and the second secondary bobbin 36 includes multiple partition plates 365 and a side plate 366. The partition plates 355 are arranged on the first secondary winding section 351. The partition plates 365 are arranged on the second secondary winding section 361. The side plates 356 and 366 are respectively arranged on the exteriors of the first secondary winding section 351 and the second secondary winding section 361. The returned segment securing parts 357 and 367 are extended outwardly from the side plates 356 and 366, respectively. The first secondary winding coil 32*a* wound around the first secondary winding section 351 includes a wound segment 32*a*1 and a returned segment 32*a*2. Similarly, the second secondary winding coil 32*b* wound around the second secondary winding section 361 includes a wound segment 32*b*1 and a returned segment 32*b*2. The returned segment 32*a*2 is fixed by the returned segment securing part 357 and then soldered on the second pin 354 through a concave structure 358 that is formed in the bottom of the first secondary bobbin 35. Similarly, the returned segment 32*b*2 is fixed by the returned segment securing part 367 and then soldered on the second pin 364 through a concave structure 368 that is formed in the bottom of the second secondary bobbin 36. In this embodiment, the returned segment securing part 357 has a recess 357*a* and the returned segment securing part 367 has a recess 367*a* for facilitating guiding the first secondary winding coil 32*a* and the second secondary winding coil 32*b*, respectively.

Figure 6:
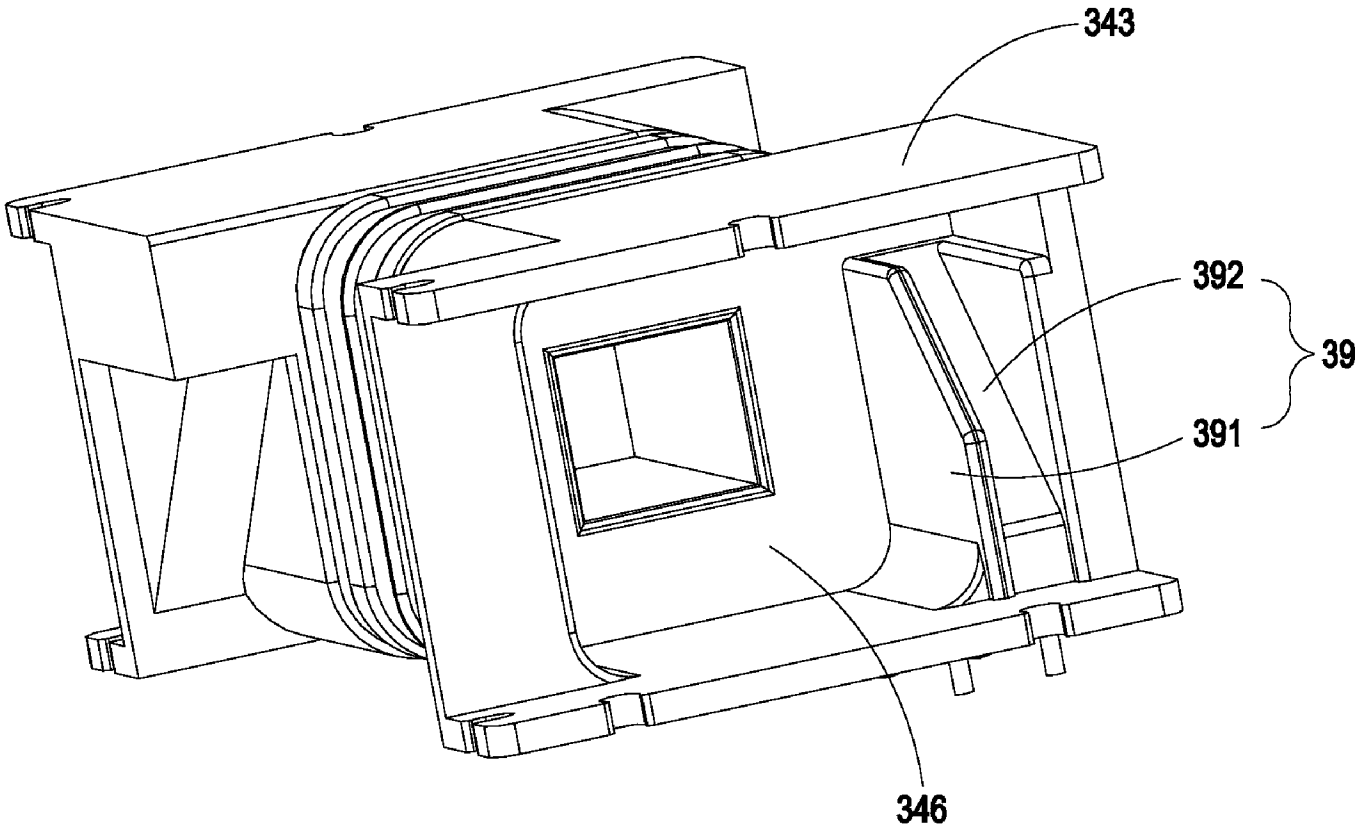
FIG. 6 is a schematic perspective view illustrating the primary bobbin of the transformer shown in FIG. 4.

FIG. 6 is a schematic perspective view illustrating the primary bobbin of the transformer shown in FIG. 4. Please refer to FIGS. 4A, 4B, 5A-5C and 6. The first sheathing part 343 of the primary bobbin 34 has a first receptacle 346. The first secondary winding section 351 of the first secondary bobbin 35 is accommodated within the first receptacle 346 of the first sheathing part 343 of the primary bobbin 34. The second sheathing part 344 of the primary bobbin 34 has a second receptacle 347. The second secondary winding section 361 of the second secondary bobbin 36 is accommodated within the second receptacle 347 of the second sheathing part 344 of the primary bobbin 34. The separation structure 39 includes a separation plate 391 and a receiving part 392. The receiving part 392 is defined by the separation plate 391. The receiving part 392 is used for accommodating the returned segment 32*a*2 and separating the wound segment 32*a*1 from the returned segment 32*a*2.

Please refer to FIGS. 5A-5C and 6 again. For winding the first secondary winding coil 32*a* around the first secondary bobbin 35, the first terminal of the first secondary winding coil 32*a* is firstly soldered on the first coupling part 353*a* of the first pin 353. The first secondary winding coil 32*a* is then successively wound on the first secondary winding section 351, thereby forming the wound segment 32*a*1. The first secondary winding coil 32*a* is guided by the recess 357*a* of the returned segment securing part 357, and then returned back toward the second pin 354 to form the returned segment 32*a*2. Afterwards, the second terminal of the first secondary winding coil 32*a* is soldered on the first coupling part 354*a* of the second pin 354. Next, the first secondary bobbin 35 is accommodated within the first receptacle 346 of the first sheathing part 343 of the primary bobbin 34. As such, the returned segment 32*a*2 is accommodated within the receiving part 392, and the wound segment 32*a*1 and the returned segment 32*a*2 are separated from each other by the separation plate 391. Since the electrical safety distance is increased, the problem of causing high-voltage spark or short circuit is avoided. The process of winding the second secondary winding coil 32*b* around the second secondary bobbin 36 is similar to that of winding the first secondary winding coil 32*a* around the first secondary bobbin 35, and is not redundantly described herein.

Figure 7:
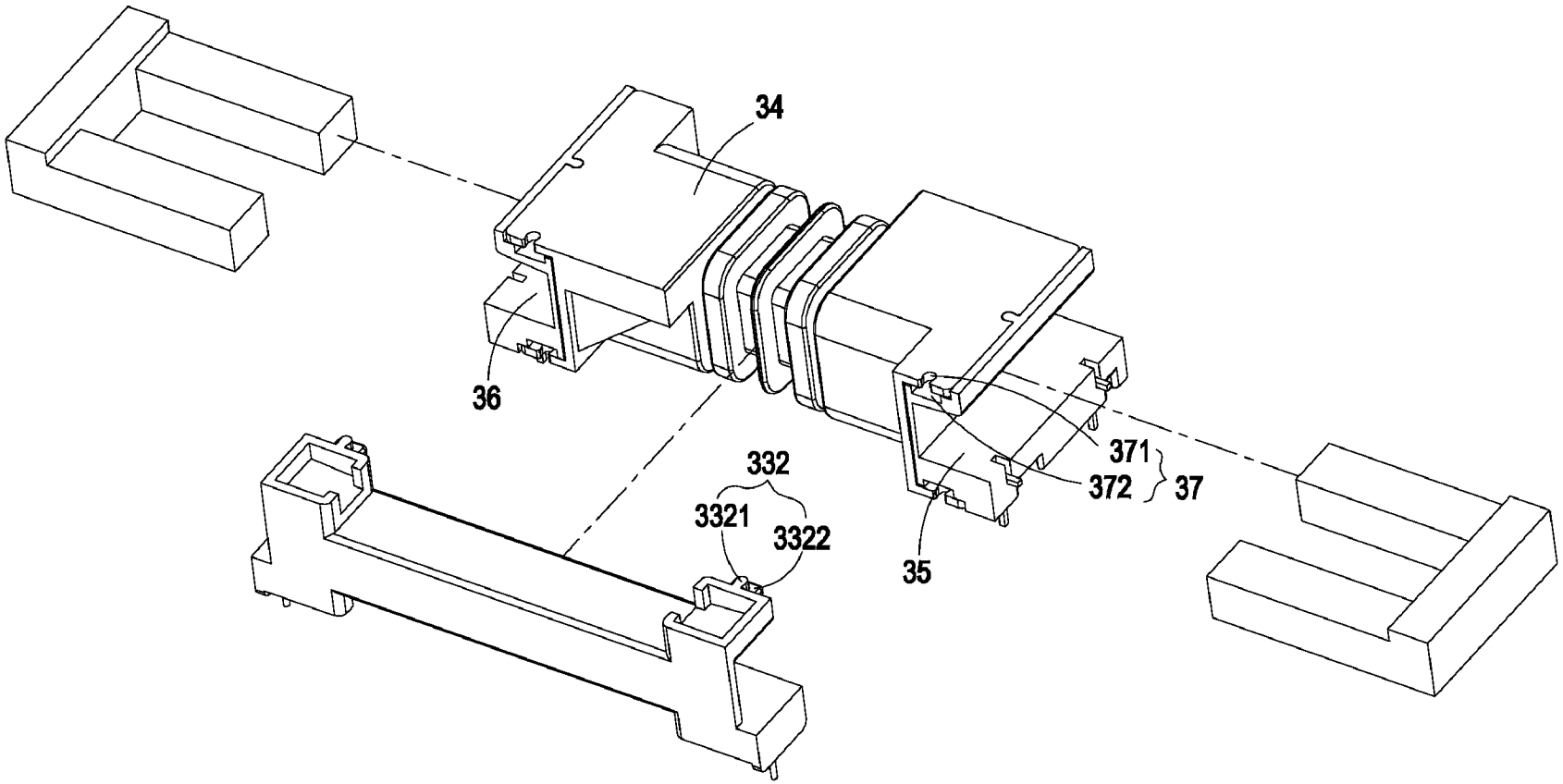
FIG. 7 is a schematic exploded view illustrating the connection between the bobbin assembly and the magnetic core covering element of the transformer shown in FIG. 4.

FIG. 7 is a schematic exploded view illustrating the connection between the bobbin assembly and the magnetic core covering element of the transformer shown in FIG. 4. As shown in FIG. 7, the bobbin assembly 30 has a first connecting part 37 including a first engaging element 371 and a first guiding element 372. In an embodiment, the first engaging element 371 is arranged on the primary bobbin 34, and the first guiding element 372 is arranged on the first secondary bobbin 35 and/or the second secondary bobbin 36. After the first secondary bobbin 35 is accommodated within the first receptacle 346 of the first sheathing part 343 of the primary bobbin 34, the first guiding element 372 is disposed in the vicinity of the first engaging element 371. Moreover, the magnetic core covering element 33 has a second connecting part 332 corresponding to the first engaging element 371 of the bobbin assembly 30. When the first engaging element 371 and the second connecting part 332 are coupled or engaged with each other, the magnetic core covering element 33 is combined with the bobbin assembly 30. Corresponding to the first engaging element 371 and the first guiding element 372, the second connecting part 332 of the magnetic core covering element 33 includes a second engaging element 3321 and a second guiding element 3322, respectively.

In this embodiment, the first engaging element 371 and the first guiding element 372 of the first connecting part 37 are respectively a notch and a guiding slot; and the second engaging element 3321 and the second guiding element 3322 of the second connecting part 332 are respectively a protrusion and a guiding block. Alternatively, the first engaging element 371 and the first guiding element 372 of the first connecting part 37 are respectively a protrusion and a guiding block; and the second engaging element 3321 and the second guiding element 3322 of the second connecting part 332 are respectively a notch and a guiding slot. Due to the engagement between the first engaging element 371 of the bobbin assembly 30 and the second connecting part 332 of the magnetic core covering element 33, the magnetic core covering element 33 and the bobbin assembly 30 are combined together.

From the above embodiment, the transformer of the present invention is effective for enhancing the electrical safety between the winding coils and the electrical safety between the coils and the magnetic core assembly. The transformer has a modular structure in order to reduce the fabricating cost and simplify the fabricating process. Moreover, the transformer is capable of avoiding high-voltage spark or short circuit so as to prevent damage of the transformer.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a bobbin assembly comprising:

a primary bobbin including a first sheathing part, wherein at least one primary winding coil is wound around said primary bobbin, said first sheathing part has a first receptacle, and a separation structure is formed within said first receptacle of said first sheathing part;

a first secondary bobbin accommodated within said first receptacle of said first sheathing part, wherein a first secondary winding coil is wound around said first secondary bobbin and includes a wound segment and a returned segment, and said wound segment and said returned segment are separated from each other by said separation structure; and a first channel;

a magnetic core covering element coupled with said bobbin assembly, and including a second channel; and a magnetic core assembly partially embedded into said first channel of said bobbin assembly and said second channel of said magnetic core covering element.

2. The transformer according to claim 1 wherein said primary bobbin further includes a first primary winding section, a second primary winding section, a second sheathing part and a first through-hole, and said first secondary bobbin further includes a first secondary winding section and a second through-hole.

3. The transformer according to claim 2 wherein said bobbin assembly further includes a second secondary bobbin, and said second secondary bobbin includes a second secondary winding section and a third through-hole, wherein said first through-hole of said primary bobbin, said second through-hole of said first secondary bobbin and said third through-hole of said second secondary bobbin collectively define said first channel of said bobbin assembly.

4. The transformer according to claim 3 wherein said first secondary winding coil and a second secondary winding coil are respectively wound around said first secondary winding section of said first secondary bobbin and said second secondary winding section of said second secondary bobbin, and said at least one primary winding coil includes a first primary winding coil and a second primary winding coil, which are respectively wound around said first primary winding section and said second primary winding section of said primary bobbin.

5. The transformer according to claim 4 wherein said first secondary winding section of said first secondary bobbin is accommodated within said first receptacle of said first sheathing part, and said second sheathing part has a second receptacle for accommodating said second secondary winding section of said second secondary bobbin.

6. The transformer according to claim 5 wherein said first through-hole is communicated with said first receptacle and said second receptacle.

7. The transformer according to claim 4 wherein said magnetic core assembly includes a first magnetic part and a second magnetic part, wherein each of said first magnetic part and said second magnetic part includes a first lateral leg and a second lateral leg.

8. The transformer according to claim 7 wherein said first lateral leg of said first magnetic part and said first lateral leg of said second magnetic part are embedded into said first channel, and said second lateral leg of said first magnetic part and said second lateral leg of said second magnetic part are embedded into said second channel.

9. The transformer according to claim 4 wherein said first primary winding section, said second primary winding section, said first sheathing part and said second sheathing part of said primary bobbin are separated from each other by at least one partition plate.

10. The transformer according to claim 4 wherein said first sheathing part and said second sheathing part are arranged at opposite sides of said primary bobbin, and said first primary winding section and said second primary winding section are arranged between said first sheathing part and said second sheathing part.

11. The transformer according to claim 4 wherein said primary bobbin further includes multiple pins, which are connected to terminals of said first primary winding coil or said second primary winding coil and inserted into a circuit board.

12. The transformer according to claim 4 wherein each of said first secondary bobbin and said second secondary bobbin has a first pin and a second pin.

13. The transformer according to claim 12 wherein each of said first pin and said second pin has a first coupling part and a second coupling part, which are perpendicular to each other.

14. The transformer according to claim 1 wherein said separation structure includes a separation plate and a receiving part, said receiving part is defined by said separation plate for accommodating said returned segment, and said wound segment is separated from said returned segment by said separation plate.

15. The transformer according to claim 14 wherein a side plate is arranged on an exterior of said first secondary winding section, a returned segment securing part is extended outwardly from said side plate, and a concave structure is formed in a bottom of said first secondary bobbin, wherein said first secondary winding coil is wound around said first secondary winding section, returned back through said returned segment securing part of said side plate, and extended out of said first secondary bobbin through said concave structure.

16. The transformer according to claim 15 wherein said returned segment securing part has a recess for facilitating guiding said first secondary winding coil.

17. The transformer according to claim 1 wherein said bobbin assembly includes at least one first connecting part, said magnetic core covering element includes at least one second connecting part, and said first connecting part is engaged with said second connecting part such that said magnetic core covering element and said bobbin assembly are combined together.

18. The transformer according to claim 17 wherein said first connecting part includes a first engaging element and a first guiding element, and said second connecting part includes a second engaging element corresponding to said first guiding element and a second guiding element corresponding to said first guiding element.

19. The transformer according to claim 18 wherein said first engaging element is arranged on said primary bobbin, said first guiding element is arranged on said first secondary bobbin and/or second secondary bobbin and disposed in the vicinity of said first engaging element, and said second engaging element and said second guiding element are arranged on said magnetic core covering element.

* * * * *